US010907360B2

(12) United States Patent
Vukelic

(10) Patent No.: US 10,907,360 B2
(45) Date of Patent: Feb. 2, 2021

(54) SHELF ANGLE SUPPORT

(71) Applicant: Zoran Vukelic, North Vancouver (CA)

(72) Inventor: Zoran Vukelic, North Vancouver (CA)

( * ) Notice: Subject to any disclaimer, the term of this patent is extended or adjusted under 35 U.S.C. 154(b) by 0 days.

(21) Appl. No.: 16/610,438

(22) PCT Filed: May 1, 2018

(86) PCT No.: PCT/CA2018/050516
§ 371 (c)(1),
(2) Date: Nov. 1, 2019

(87) PCT Pub. No.: WO2018/201245
PCT Pub. Date: Nov. 8, 2018

(65) Prior Publication Data

US 2020/0056378 A1 Feb. 20, 2020

Related U.S. Application Data

(60) Provisional application No. 62/492,766, filed on May 1, 2017.

(51) Int. Cl.
*E04F 13/08* (2006.01)
*E04B 1/41* (2006.01)

(52) U.S. Cl.
CPC ..... *E04F 13/0801* (2013.01); *E04B 1/4178* (2013.01)

(58) Field of Classification Search
CPC .... E04B 1/4178; E04F 13/22; E04F 13/0801; E04F 13/0857
See application file for complete search history.

(56) References Cited

U.S. PATENT DOCUMENTS 3,568,391 A * 3/1971 Conway ..... E04B 1/7023 52/586.2
3,672,108 A * 6/1972 Conway ..... E04B 1/7023 52/367
6,128,883 A * 10/2000 Hatzinikolas ..... E04B 1/4178 52/378
7,908,804 B2 * 3/2011 Vieira ..... E04C 3/02 52/204.2

(Continued)

FOREIGN PATENT DOCUMENTS

CA 2254510 5/2000
CA 2872780 6/2016
KR 10-2015-0079384 7/2015

OTHER PUBLICATIONS

Arborus Efficiency Journal, How to Maximize Thermal Pertormance in a Wall Assembly, Sep. 8, 2015.

(Continued)

*Primary Examiner* — Andrew J Triggs
(74) *Attorney, Agent, or Firm* — Oyen Wiggs Green & Mutala LLP

(57) ABSTRACT

A shelf angle suitable for supporting a brick veneer is attached to a building wall by way of plural spacer members each comprising inner and outer plates joined by a web of material. The spacer member may comprise a tube or c-section for example. Thermally insulating sheets are compressed between the shelf angle and the spacer member and/or between the spacer member and the building wall. The spacer members are spaced apart along the shelf angle.

27 Claims, 10 Drawing Sheets

(56) References Cited

U.S. PATENT DOCUMENTS

| | | | | |
|---|---|---|---|---|
| 9,650,789 | B2 * | 5/2017 | Gulnick | E04F 13/0801 |
| 10,480,197 | B2 * | 11/2019 | Hohmann, Jr. | E04F 13/0805 |
| 2016/0244967 | A1 * | 8/2016 | Zhou | E04F 13/0801 |
| 2020/0056378 | A1 * | 2/2020 | Vukelic | E04F 13/147 |

OTHER PUBLICATIONS

Joseph W. Lstiburek, A Bridge Too Far, Aug. 2008.
Michael Wilson, Graham Finch, James Higgins, Masonry Veneer Support Details: Thermal Bridging, Jun. 2-5, 2013.

* cited by examiner

SHELF ANGLE SUPPORT

CROSS-REFERENCE TO RELATED APPLICATION

This application claims priority from U.S. application No. 62/492,766 filed 1 May 2017. For purposes of the United States, this application claims the benefit under 35 U.S.C. § 119 of U.S. application No. 62/492,766 filed 1 May 2017 and entitled SHELF ANGLE SUPPORT which is hereby incorporated herein by reference for all purposes.

FIELD

This invention relates to apparatus for supporting brick veneer or other masonry on a building wall.

BACKGROUND

It is becoming common in building construction to provide a building wall in which a brick veneer or other masonry is spaced apart from an outer surface of a building by a gap. The gap may include an air space. In some cases, insulation is provided in the gap.

A brick veneer can be relatively heavy. It is typical to provide a shelf formed from a metal angle iron that extends along a lower surface of the brick veneer. The shelf is attached to the building wall with brackets that space the shelf angle away from the building wall by a desired distance. Various supports for shelf angles are commercially available. Many of these have disadvantages when it comes to cost and/or ease of use.

One problem with many commercially available shelf angle support systems is thermal bridging. Such systems can conduct heat away from a building and in so doing can significantly reduce the insulation value of the building wall.

SUMMARY

This invention has a number of aspects including:

shelf angle supports useful for supporting brick veneers or other masonry;

building constructions which incorporate shelf angle supports; and, methods for supporting shelf angles to building walls.

Further aspects of the invention and features of example embodiments are described below and/or depicted in the accompanying drawings.

BRIEF DESCRIPTION OF THE DRAWINGS

The accompanying drawings illustrate non-limiting example embodiments of the invention.

DETAILED DESCRIPTION

Figure 1A:
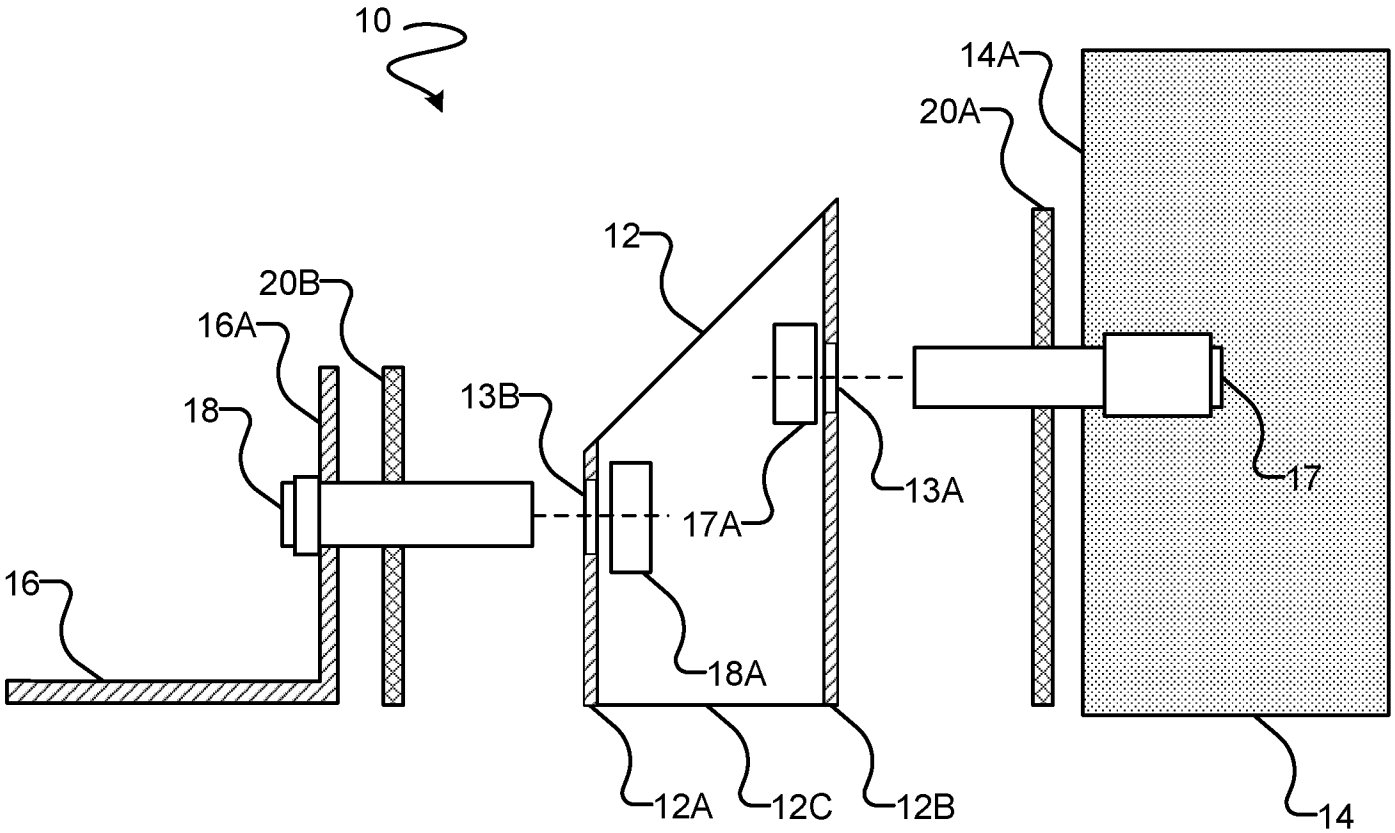
FIG. 1A is an exploded cross-sectional view of a shelf angle support bracket assembly.
Figure 7A:
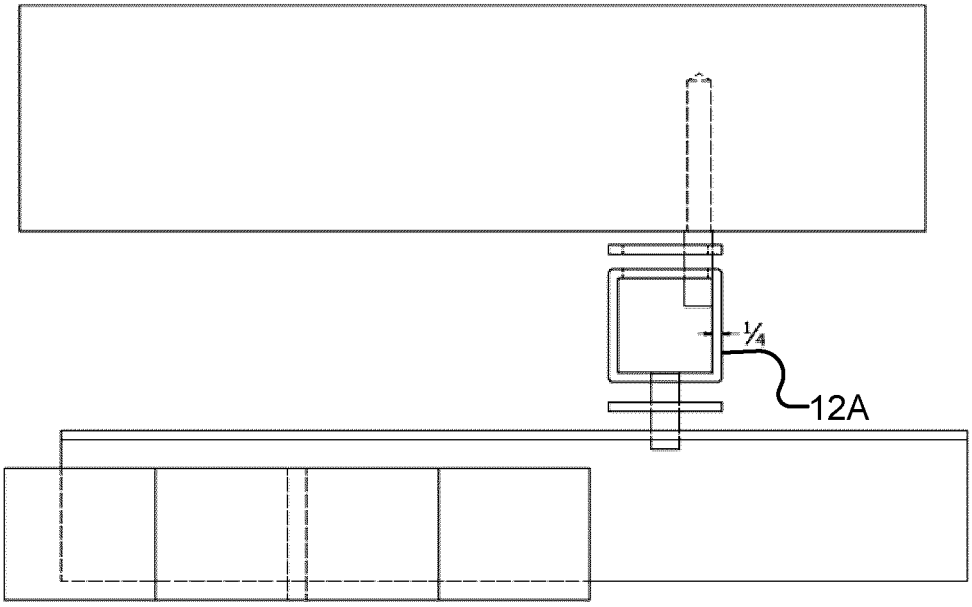
FIGS. 7A and 7B are top views of a shelf angle support bracket assembly of two example embodiments.
Figure 7B:
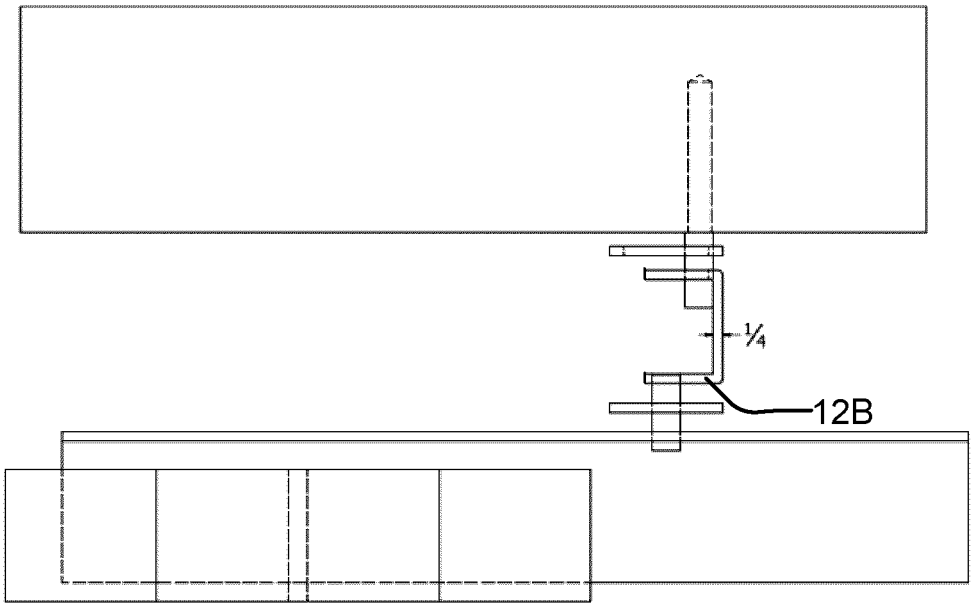
Figure 8:
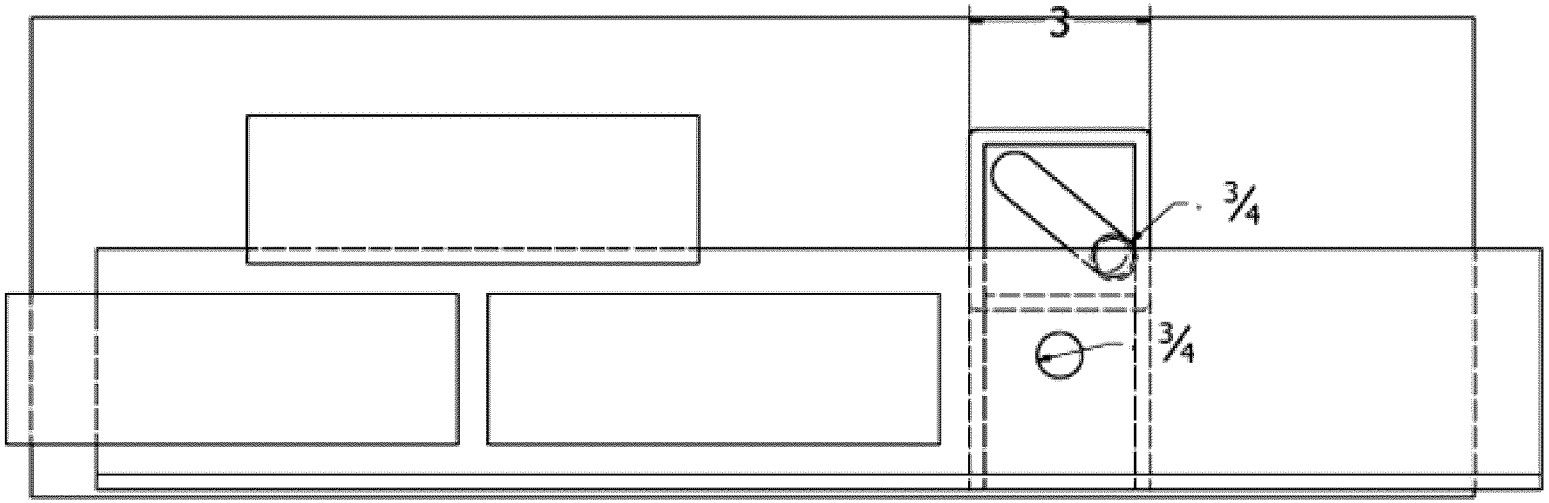
FIG. 8 is a side view of a shelf angle support bracket assembly with dimensions of an example embodiment.
Figure 9:
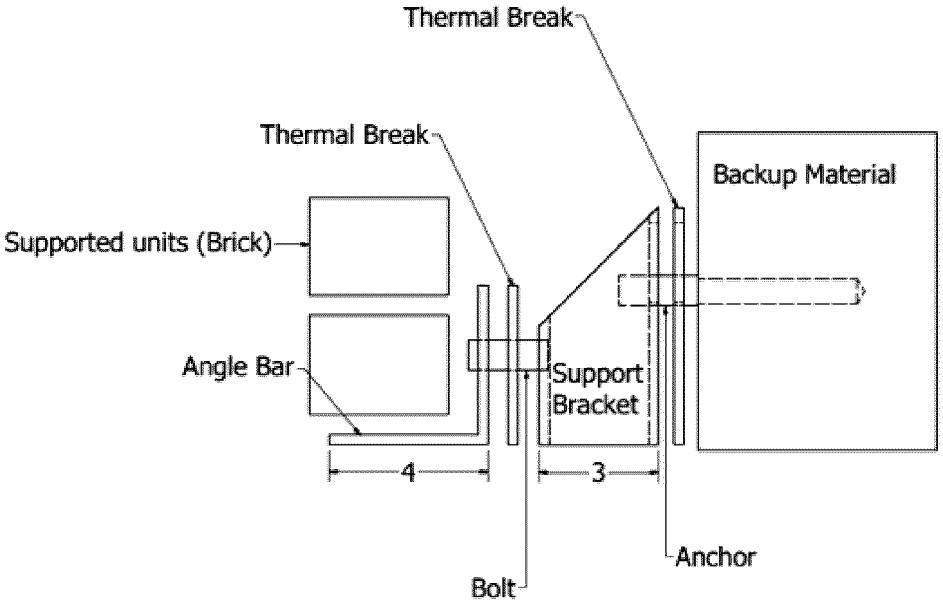
FIG. 9 is cross-sectional view of a shelf angle support bracket assembly.
Figure 10:
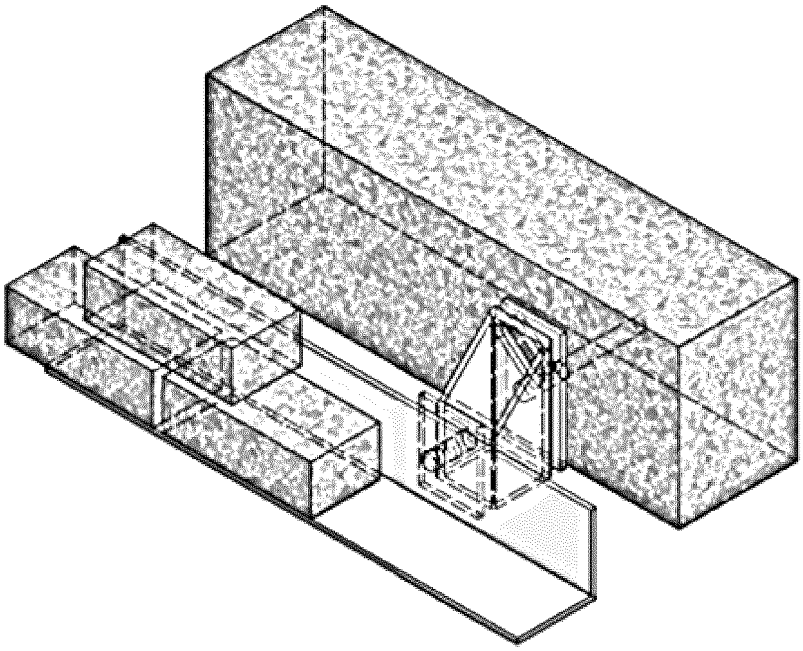
FIG. 10 is an isometric view of a shelf angle support bracket assembly.

FIG. 1A is an exploded cross-sectional view of a shelf angle support bracket assembly 10 according to an example embodiment of the invention. Assembly 10 comprises a spacer member 12 which is attached on an outer face 14A of a building wall 14. A shelf angle 16 is attached on an outer face of spacer member 12. In the illustrated embodiment, spacer member 12 comprises outer and inner plates 12A and 12B joined by at least one web 12C. For example, spacer member 12 may comprise a section of a rectangular tube or a steel c-section, as respectively shown in FIGS. 7A and 7B.

In the illustrated embodiment, spacer member 12 is attached to wall 14 by an expansion bolt 17 which passes through an aperture 13A in inner plate 12A and a nut 17A. Shelf angle 16 is attached to outer plate 12A by a bolt 18 which passes through an aperture 13B in outer plate 12B and a nut 18A.

Sheets 20A and 20B of a thermally insulating material may be provided between spacer member 12 and wall 14 and/or between spacer member 12 and shelf angle 16. Sheets 20A and 20B may be of a substantially non-compressible, thermally-insulating material such as a suitable plastic, ceramic, or the like. Sheets 20A and 20B are equal in size to the faces of plates 12A and 12B that they bear against in some embodiments. The thickness of sheets 20A, 20B may be selected to maintain a desired insulating value for the overall wall constructions. In some embodiments, sheets 20A and/or 20B have thicknesses in the range of 0.2 inches to 1 inch.

The total thickness of spacer member 12, plates 20A and/or 20B, where present, and the vertical wall 16A of shelf support angle 16 may be selected to provide a desired spacing between the outer surface of wall 14A and the inner surface of a brick veneer to be built on shelf support 16.

Sheets 20A and/or 20B are formed with apertures which allow fasteners (e.g. bolt 17 or bolt 18) to pass through. The apertures in sheets 20A and/or 20B may respectively match the shapes of apertures 13A and 13B.

In some embodiments sheets 20A and/or 20B are bonded to spacer members 12 so that spacer members 12 together with sheets 20A and/or 20B may be handled as a unit.

Figure 2:
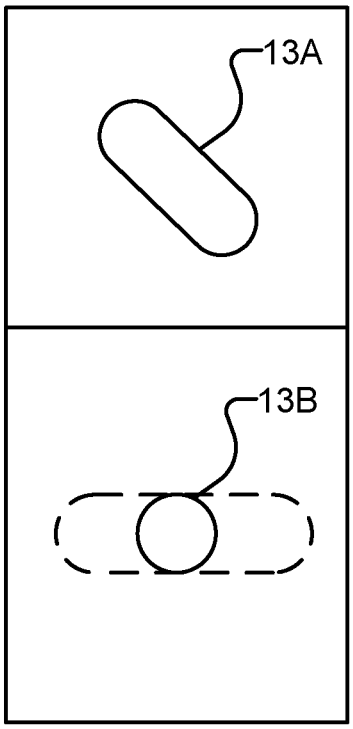
FIG. 2 is a front view of a shelf angle support bracket assembly.

In some embodiments, aperture 13A comprises a slot. This allows a range of possible positions for expansion bolt 17. In some embodiments, for example as shown in FIG. 2, aperture 13A is provided by a slot which is angled to the horizontal such that, for a given position on a wall 14 of spacer member 12, there are a range of choices for the location of expansion bolt 17, and these choices vary both in horizontal position and vertical elevation. Also, with aperture 13A provided by an angled slot, for a given position of expansion bolt 17, spacer member 12 may be adjusted by moving it horizontally to achieve a desired vertical elevation.

In some embodiments aperture 13B also comprises a slot. In such embodiments it can be advantageous to make aperture 13B in the form of a horizontally-extending slot (e.g. a slot extending transversely to spacer member 12). One benefit of making aperture 12B in the form of a horizontal slot is that holes in shelf angle 16 do not need to be placed precisely in the horizontal direction to line up with apertures 13A in space members 12.

In some cases aperture 13A comprises an angled slot as described above and aperture 13B comprises a horizontal slot as also described above and shown in dotted outline in FIG. 2. One advantage of this arrangement is that during installation of shelf angle 16, the elevation at which spacer member 12 supports shelf angle 16 can be adjusted by moving the spacer member 12 horizontally. With aperture 13B having the form of a horizontal slot aperture 13B can accommodate such relative horizontal movement between the spacer member 12 and shelf angle 16.

Shelf angle 16 may have a considerable length. Shelf angle bracket assemblies 10 are spaced apart along the length of shelf angle 16 with a desired spacing between bracket assemblies 10. Supporting shelf angle 16 with spaced-apart bracket assemblies 10 tends to reduce thermal bridging. Providing insulating sheets 20A and/or 20B further reduces the thermal bridging.

Apparatus 10 may be used in a way that is very efficient. Spacer members 12 may be attached to a wall 14 along the part of wall 14 where a shelf angle 16 will be provided. After spacer members 12 have been attached to the wall, the shelf angle 16 may be temporarily placed against spacer members 12 and held in place, for example with clamps, while the desired locations of apertures 13B are marked on shelf angle 16. After that has been done, holes may be punched in shelf angle 16 to receive bolts 18. Such holes made, for example with a portable hydraulic hole punch or magnetic drill. Such hole punches are widely available. Shelf angle 16 may then be attached to spacer members 12, for example with bolts 18 and nuts 18A. In the illustrated embodiment, upper surfaces of spacer members 12 are angled to allow ready access for tightening nut 17A.

In another example application method, two support members 12 are attached to a wall and a shelf angle 16 is attached to the two support members 12 as described above. The two support members may, for example, be at or near opposing ends of shelf angle 16. Subsequently, additional support members 12 may be attached to the wall at a desired horizontal spacing along the shelf angle 16. Positions of holes may be marked on shelf angle 16 and the additional support members may be pivoted aside to allow the corresponding holes to be punched or drilled in shelf angle 16 at the desired positions.

In any embodiments as described herein, if necessary, any of the support members 12 may be shimmed with spacers to accommodate any waviness in the surface of wall 14. In some embodiments thin spacer plates that are apertured to receive bolt 17 are provided. Such thin spacer plates may be added between a support member 12 and wall 14 and/or between a support member 12 and shelf angle 16, as needed.

In an example case, support plates may be provided in thicknesses of about ⅛ inch and about ¼ inch. Spacer plates may, for example, have approximately the same dimensions in directions parallel to wall 14 as sheets 20A, where sheets 20A are provided. Spacer plates may be made of a material such as steel, galvanized steel or stainless steel or a material having greater thermal insulation properties such as a suitable plastic, composite material or the like.

Figure 3:
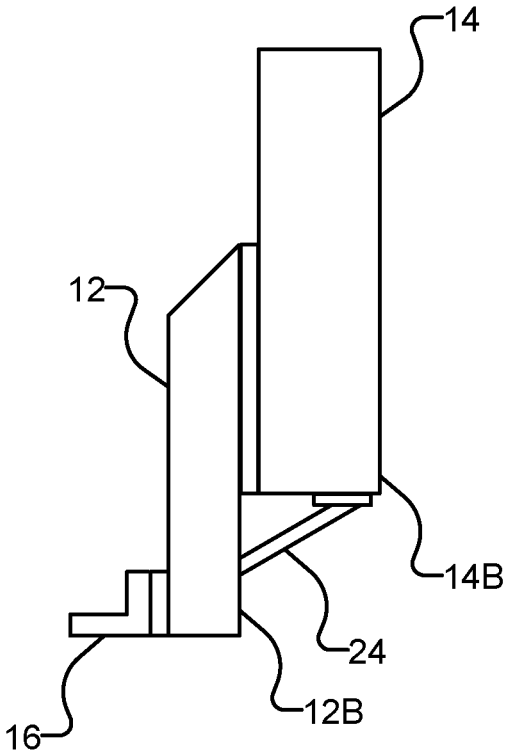
FIG. 3 is a cross sectional view of a shelf angle support with an optional angle brace.

The design of shelf angle support brackets 10 allows for considerable variation. For example, the length of spacer members 12 may be varied. This may be advantageous in cases where it is desired to have a brick veneer (or other masonry) supported below the lower edge of a wall 14. This is illustrated in FIG. 3. In FIG. 3, spacer member 12 extends below lower end 14B of wall 14. Angle brace 24 extends between lower end 14B of wall 14 and a lower portion 12B of spacer member 10. Shelf angle 16 is supported by spacer member 12 below lower end 14B of wall 14.

Wall 14 may be constructed of any suitable material. Wall 14 may be made of cement, as illustrated in FIG. 1A. Other options for the construction of wall 14 include, but are not limited to, cinder blocks, wooden or metal studs, or the like. The fastener used to attach spacer member 12 to wall 14 may be selected based on the construction of wall 14. For example, a fastener member may comprise an expansion bolt, a lag screw, a bolt, or the like.

The system as described herein may be installed extremely efficiently. Adaptation to compensate for non-planarity (waviness or the like) in the surface of wall 14 can be made readily.

Figure 1B:
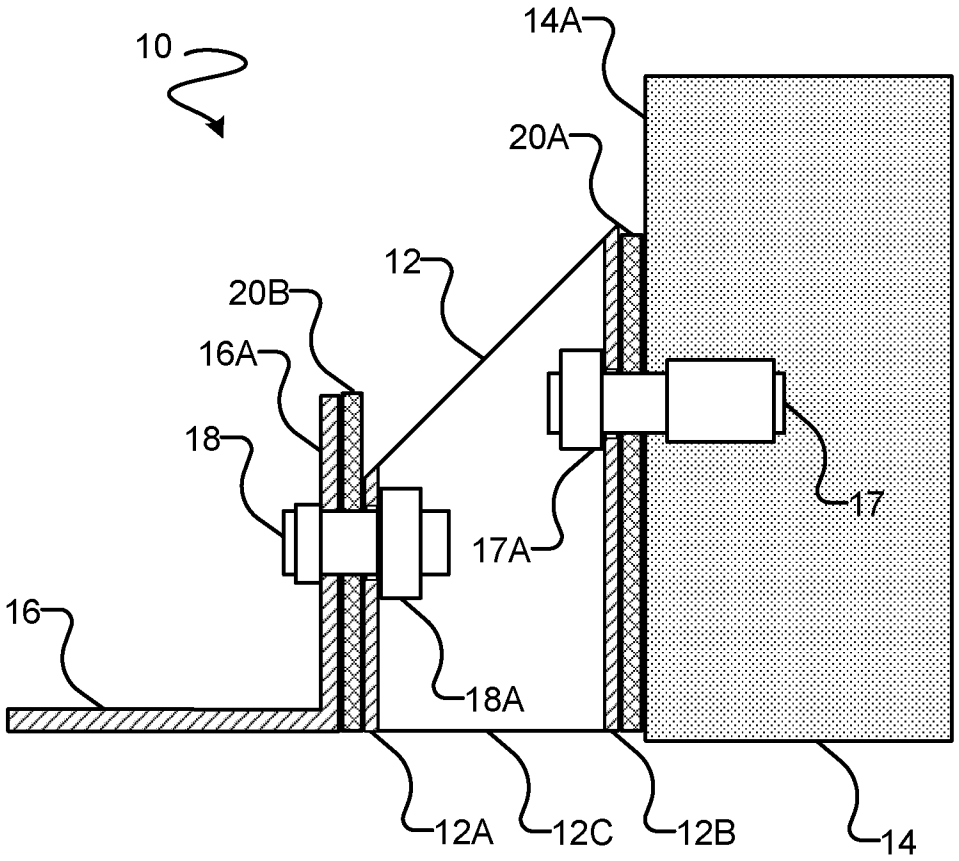
FIG. 1B is a cross-sectional view of an assembled shelf angle support bracket assembly.

FIG. 1B is a cross-sectional view of an assembled shelf angle support bracket assembly. When assembled, bolts 17 and 18 hold insulation 20A and 20B tightly between shelf angle 16, spacer member 12, and wall 14.

Figure 4:
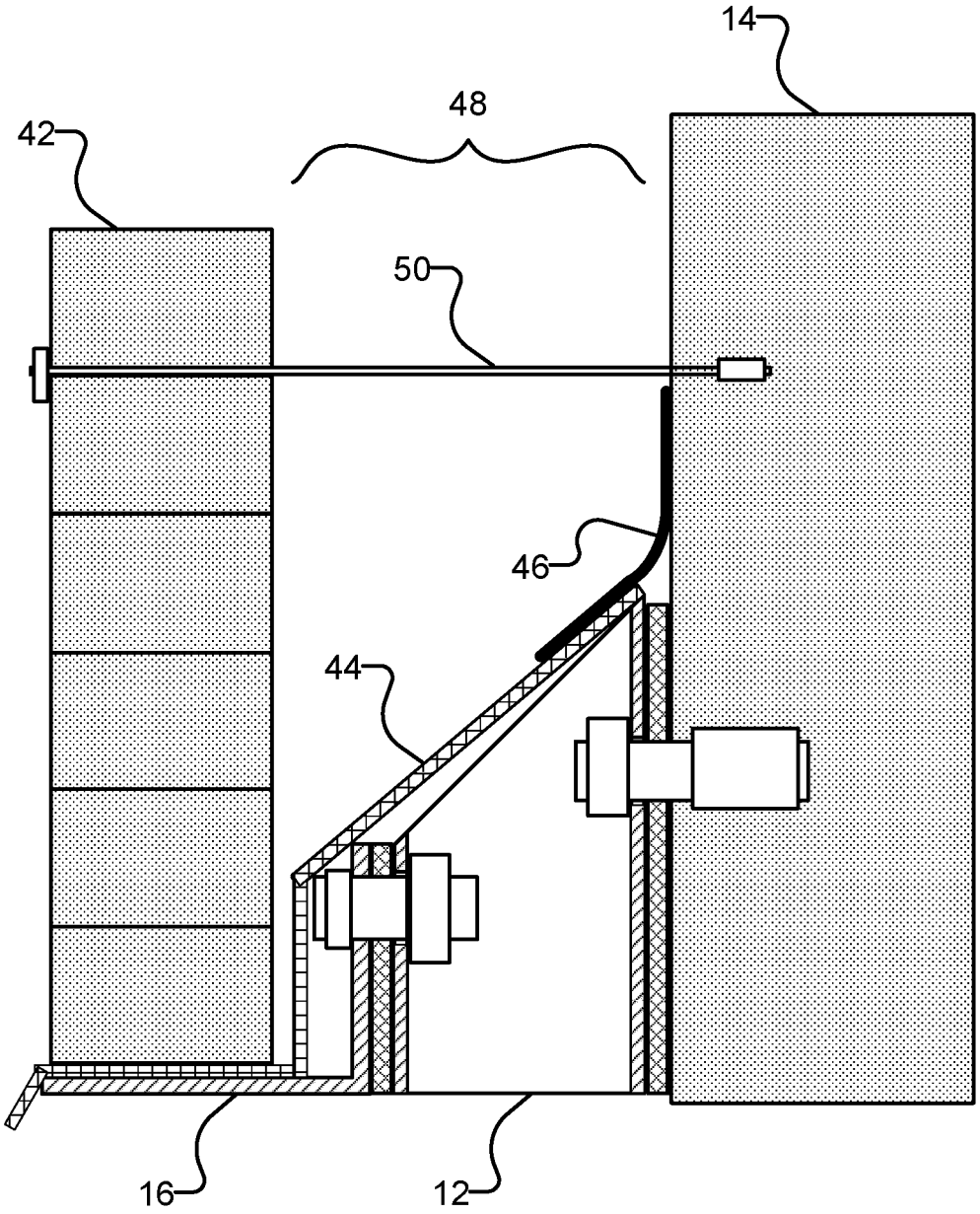
FIG. 4 is a cross sectional view of a shelf angle with optional flashing according to one example embodiment.

FIG. 4 is a cross-section of a wall showing a brick veneer 42 supported by a shelf angle 16 which is in turn attached to a wall 14 by a plurality of shelf angle support brackets 10 as described herein. FIG. 4 also shows how a flashing 44 may be carried down over the top of a spacer member 12 onto shelf angle 16. A piece of self-adhesive flashing 46 may be adhered to wall 14 and to flashing 44 such that any water falling down within cavity 48 between brick veneer 42 and wall 14 is carried to the outside by flashing 44 and 46. Also shown in FIG. 4 are brick ties 50 which tie brick veneer 42 to wall 14 at locations above shelf angle 16. Insulation may be provided in gap 48 if desired.

Spacer member 12 may be made of any of a variety of materials including red iron, galvanized steel, mild steel, or stainless steel. Stainless steel is advantageous for providing reduced thermal conductivity.

Figure 4A:
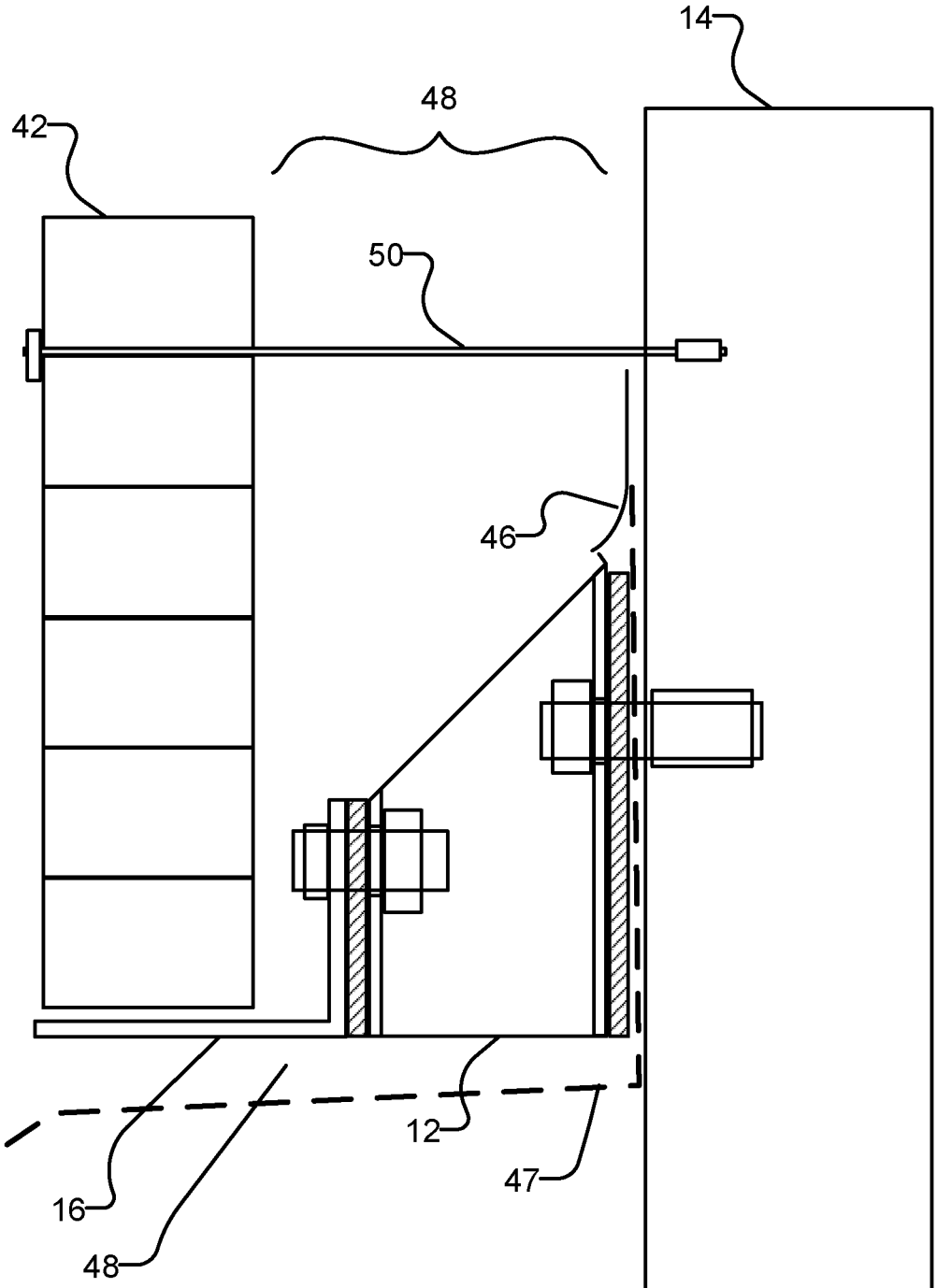
FIG. 4A is a cross sectional view of a shelf angle with optional flashing according to another example embodiment.
Figure 5:
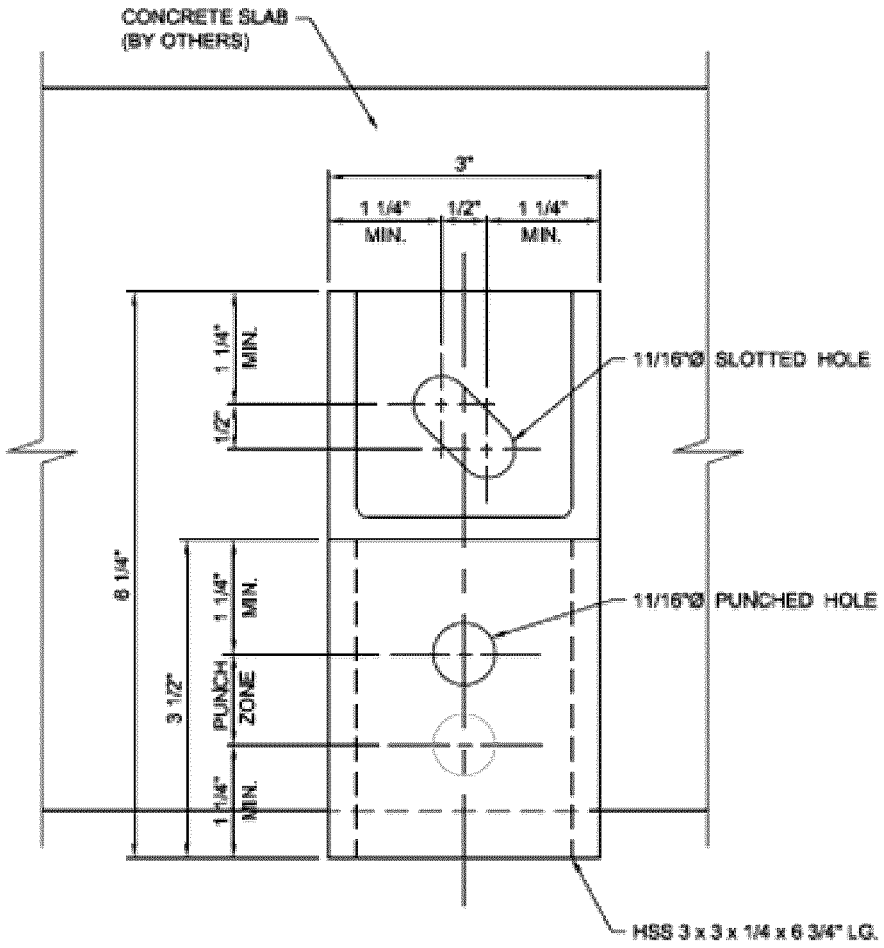
FIG. 5 is a front view of a shelf angle support bracket assembly with dimensions of an example embodiment.
Figure 6:
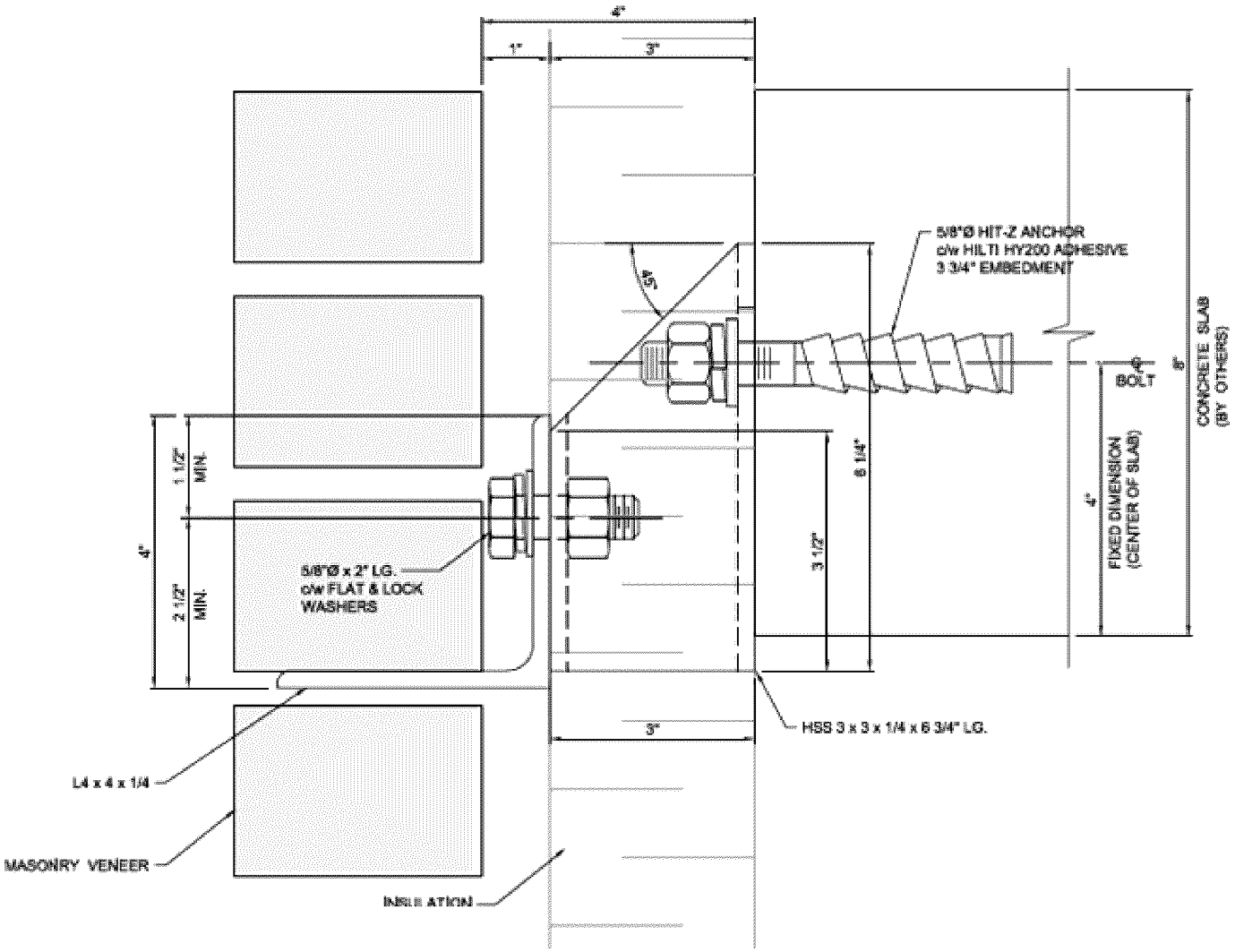
FIG. 6 is a cross-sectional view of a shelf angle support bracket assembly with dimensions of an example embodiment.

FIG. 4A is similar to FIG. 4 and shows an alternative way to provide flashing. In FIG. 4A the flashing comprises an angle flashing 47 that extends under shelf angle 16. A gap 48 may be provided under shelf bracket 16. Gap 48 may, for example, have a thickness that is similar to the spacing between two rows of bricks in brick veneer 42. Water that flows down wall 14 is caught by angle flashing 47 and directed to the outside of brick veneer 42. Advantageously, water being directed by flashing 47 does not need to come into direct contact with the bricks of veneer 42. This can reduce the formation of mineral deposits on the bricks. The design illustrated in FIG. 4A can be used to advantage over windows as well as over lower sections of brick veneer 42.

In methods according to some embodiment a shelf angle 16 is used to support scaffolding, such as a Hydro-Mobile™ mast-climbing work platform against pulling away from a building. One brick can be left out at a location at which the scaffolding is coupled to shelf angle 16. The brick may be placed as the scaffolding is being taken down.

Interpretation of Terms

Unless the context clearly requires otherwise, throughout the description and the claims:

"comprise", "comprising", and the like are to be construed in an inclusive sense, as opposed to an exclusive or exhaustive sense; that is to say, in the sense of "including, but not limited to";

"connected", "coupled", or any variant thereof, means any connection or coupling, either direct or indirect, between two or more elements; the coupling or connection between the elements can be physical, logical, or a combination thereof;

"herein", "above", "below", and words of similar import, when used to describe this specification, shall refer to this specification as a whole, and not to any particular portions of this specification;

"or", in reference to a list of two or more items, covers all of the following interpretations of the word: any of the items in the list, all of the items in the list, and any combination of the items in the list;

the singular forms "a", "an", and "the" also include the meaning of any appropriate plural forms.

Words that indicate directions such as "vertical", "transverse", "horizontal", "upward", "downward", "forward", "backward", "inward", "outward", "vertical", "transverse", "left", "right", "front", "back", "top", "bottom", "below", "above", "under", and the like, used in this description and any accompanying claims (where present), depend on the specific orientation of the apparatus described and illustrated. The subject matter described herein may assume various alternative orientations. Accordingly, these directional terms are not strictly defined and should not be interpreted narrowly.

Brick can include any masonry materials suitable for providing a veneer on a building.

Where a component (e.g. a bracket, bolt, fastener, washer, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of systems, methods and apparatus have been described herein for purposes of illustration. These are only examples. The technology provided herein can be applied to systems other than the example systems described above. Many alterations, modifications, additions, omissions, and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions, and sub-combinations as may reasonably be inferred. The scope of the claims should not be limited by the preferred embodiments set forth in the examples, but should be given the broadest interpretation consistent with the description as a whole.

What is claimed is:

1. An apparatus for supporting a veneer spaced apart from a wall, the apparatus comprising:

a spacer member secured to the wall, the spacer member comprising:

an inner plate of a first length;

an outer plate of a second length less than the first length; and a rigid web joining the inner plate and outer plate;

a shelf angle secured to the outer plate;

an insulator between the inner plate and the wall wherein the insulator covers substantially all of the inner plate.

2. The apparatus according to claim 1 wherein the shelf angle is secured to the outer plate by a first bolt passing through a first aperture in the shelf angle and a second aperture in the outer plate.

3. The apparatus according to claim 2 wherein the second aperture comprises a horizontally-extending slot.

4. The apparatus according to claim 2 wherein the first aperture comprises a substantially circular hole.

5. The apparatus according to claim 2 wherein the spacer member is secured to the wall by a second bolt passing through a third aperture in the inner plate.

6. The apparatus according to claim 5 wherein the third aperture comprises an angled slot.

7. The apparatus according to claim 5 wherein the spacer member comprises a tube having a rectangular cross section, an upper end of the tube is angled such that a top edge of the inner plate is above a top edge of the outer plate and the third aperture vertically positioned above the top edge of the outer plate and below the top edge of the inner plate.

8. The apparatus according to claim 5 wherein the second bolt comprises an expansion bolt.

9. The apparatus according to claim 1 comprising an additional insulator located between the outer plate and the shelf angle wherein the additional insulator covers substantially all of the outer plate.

10. The apparatus according to claim 9 wherein the additional insulator comprises a thermal insulator.

11. The apparatus according to claim 10 wherein the additional insulator comprises a non-compressible material.

12. The apparatus according to claim 1 wherein the insulator comprises a thermal insulator.

13. The apparatus according to claim 12 wherein the insulator comprises a non-compressible material.

14. The apparatus according to claim 1 wherein the rigid web comprises a single, continuous support extending between the inner plate and the outer plate.

15. The apparatus according to claim 1 wherein the spacer member is C-shaped in cross section.

16. The apparatus according to claim 1 wherein the rigid web comprises two or more continuous supports extending between the inner plate and the outer plate.

17. The apparatus according to claim 1 wherein the spacer member comprises a tube having a rectangular cross section.

18. The apparatus according to claim 17 wherein an upper end of the tube is angled such that a top edge of the inner plate is above a top edge of the outer plate.

19. The apparatus according to claim 1 wherein the wall has a lower end and a lower end of the spacer member extends below the lower end of the wall.

20. The apparatus according to claim 19 comprising an angle brace extending between the wall and a portion of the spacer member extending below the wall.

21. The apparatus according to claim 1 comprising a veneer supported by the shelf angle and a veneer tie extending between the veneer and the wall above the inner plate and outer plate.

22. The apparatus according to claim 1 comprising a flashing extending from the wall above the inner plate over the inner plate and the outer plate, and secured to a side of the outer plate between the outer plate and the shelf angle.

23. The apparatus according to claim 1 comprising an additional thermal insulator located between the outer plate and the shelf angle.

24. A method for securing a shelf angle to a wall using a spacer member, the method comprising:

placing a spacer member having an inner plate and an outer plate connected by a rigid web against a wall;

placing a first insulator between the wall and the spacer member;

aligning a first aperture in the inner plate of the spacer member with a hole in the wall by horizontally sliding the spacer member;

securing the spacer member to the wall and securing the first insulator between the wall and the spacer member;

placing a second insulator against the outer plate;

placing a shelf angle against the second insulator;

punching a hole through the shelf angle wherein the hole in the shelf angle is aligned with a second aperture in the outer plate;

securing the shelf angle to the outer plate and securing the second insulator between the outer plate and shelf angle by securing a bolt through the second aperture and the hole in the shelf angle.

25. The method according to claim 24 wherein securing the spacer member to the wall and securing the first insulator between the wall and the spacer member comprises driving an expansion bolt through the first aperture through the first insulator and into the hole in the wall.

26. The method according to claim 24 wherein aligning the first aperture in the inner plate of the spacer member with the hole in the wall comprises sliding the spacer member along the wall to align a sloping slot in the spacer member with the hole.

27. The method according to claim 24 wherein:

the second aperture in the outer plate comprises a horizontally-extending slot; and punching the hole through the shelf angle comprises aligning a center of the shelf angle with the horizontally-extending slot in the outer plate.

* * * * *